US005494375A

United States Patent [19]

Yates

[11] Patent Number: 5,494,375

[45] Date of Patent: Feb. 27, 1996

[54] WHEEL SUPPORT MEMBER FOR COMPACTOR

[75] Inventor: Steve K. Yates, Scottland, Pa.

[73] Assignee: Ingersoll-Rand Company, Woodcliff Lake, N.J.

[21] Appl. No.: 298,809

[22] Filed: Aug. 31, 1994

[51] Int. Cl.[6] ..... E01C 19/26

[52] U.S. Cl. ..... 404/126; 180/20; 172/518

[58] Field of Search ..... 404/122, 125, 404/126; 172/518, 580; 180/20

[56] References Cited

U.S. PATENT DOCUMENTS

| | | | |
|---|---|---|---|
| 2,295,645 | 9/1942 | Flynn | 404/126 X |
| 2,407,965 | 9/1946 | Smith . | |
| 2,706,121 | 4/1955 | Ronning . | |
| 3,025,775 | 3/1962 | Grace . | |
| 3,060,818 | 10/1962 | Roberts . | |
| 3,249,027 | 5/1966 | Peterson | 404/126 |
| 3,319,545 | 5/1967 | Seaman . | |
| 4,157,877 | 6/1979 | Lee . | |

*Primary Examiner*—William P. Neuder
*Attorney, Agent, or Firm*—John J. Selko

[57] ABSTRACT

A mobile, ground compacting vehicle includes a front row of compacting wheels and a rear row of compacting wheels. The rear row includes two spaced-apart, driven wheel assemblies, each wheel assembly carrying a pair of rims, with a and tire on each rim. A center wheel assembly carries a single rim and tire thereon and is positioned between the spaced-apart wheel assemblies. For replacement of an inner tire of the driven wheel assemblies, the center wheel assembly can be pivoted to the side to provide access to the adjacent wheel assembly lug nuts.

14 Claims, 2 Drawing Sheets

WHEEL SUPPORT MEMBER FOR COMPACTOR

BACKGROUND OF THE INVENTION

This invention relates generally to mobile ground compacting vehicles, and more particularly to means for connecting a row of ground compacting tires to the vehicle for easy access to the tires for replacement thereof. As used herein, the term "ground" can mean soil or asphalt.

Present ground compactors have a center pneumatic tire on a wheel rim that is positioned in a row of ground compacting tires connected to the rear frame portion of the vehicle. The center tire is located between two sets of tires that are driven. The spacing of the tires barely allows room for the removal of any but the outer two tires from its wheel rim. The present mounting arm for the center tire does not readily allow altering of the spacing between the mounting arm and the next tire, so as to permit convenient removal of the inner tires next to the center tire.

The foregoing illustrates limitations known to exist in present compactors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a mobile, steerable ground compacting vehicle having a body with a front frame portion and a rear frame portion, the body supported by a first row of laterally spaced wheels connected to the front frame portion, and a second row of laterally spaced wheels connected to the rear frame portion, the wheels of each row being aligned with the spaces of the other row, so that a ground engaging portion of the first and second rows overlap to cover an area between outermost wheels, the second row of wheels comprising: first support means fixed to the rear frame portion, extending downwardly from the rear frame portion along a first vertical plane, and a first wheel assembly removably fastened to the first support means; second support means fixed to the rear frame portion, extending downwardly from the rear frame portion along a second vertical plane parallel to the first vertical plane, the second support means spaced laterally from the first support means, and a second wheel assembly removably fastened to the second support means; third support means extending downwardly from the rear frame portion, the third support means spaced intermediate the first and second support means, and a third wheel assembly removably fastened to the third support means and means for pivoting the third support means about an axis in a third vertical plane parallel to the first and second vertical planes, whereby spacing between the third support means and the first and second support means can be varied, to provide access to the first and second wheel assemblies for replacement thereof.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
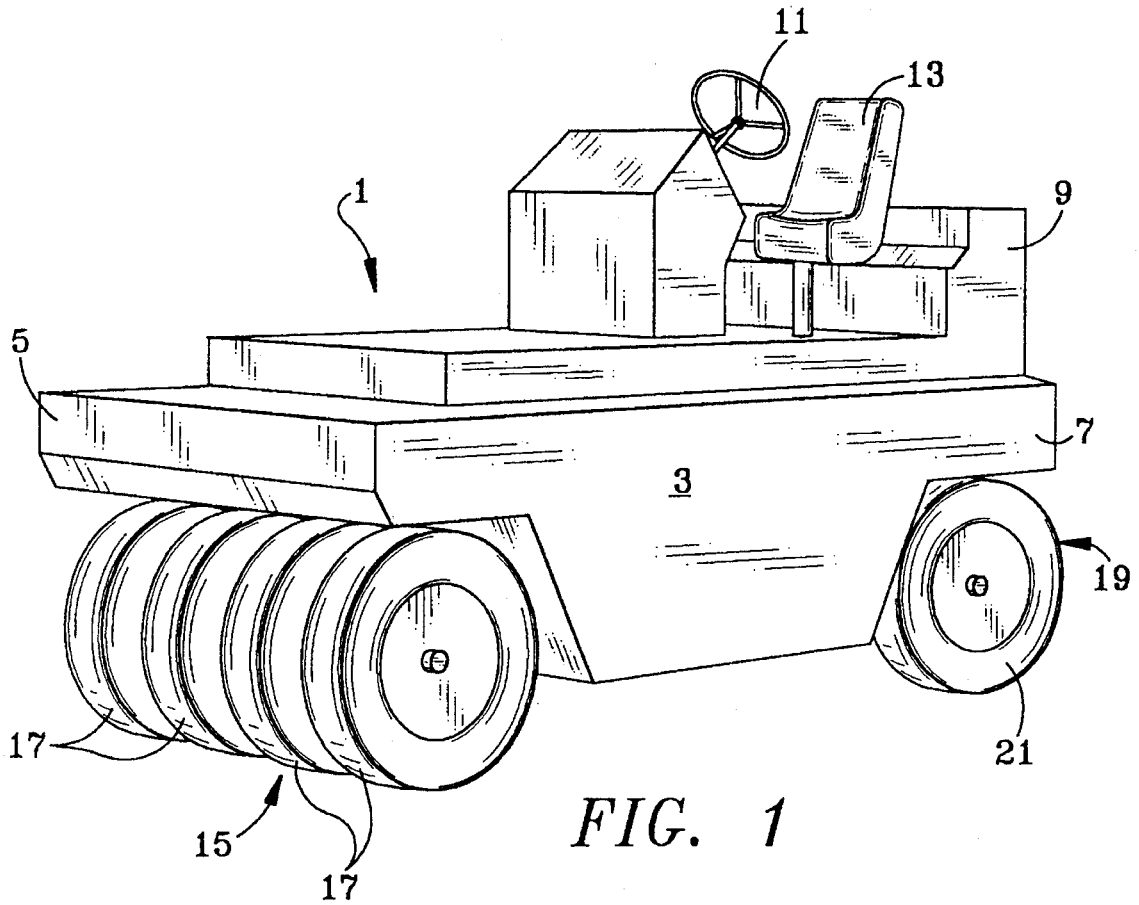
FIG. 1 is an isometric schematic view, with parts removed, of the vehicle of the invention.
Figure 2:
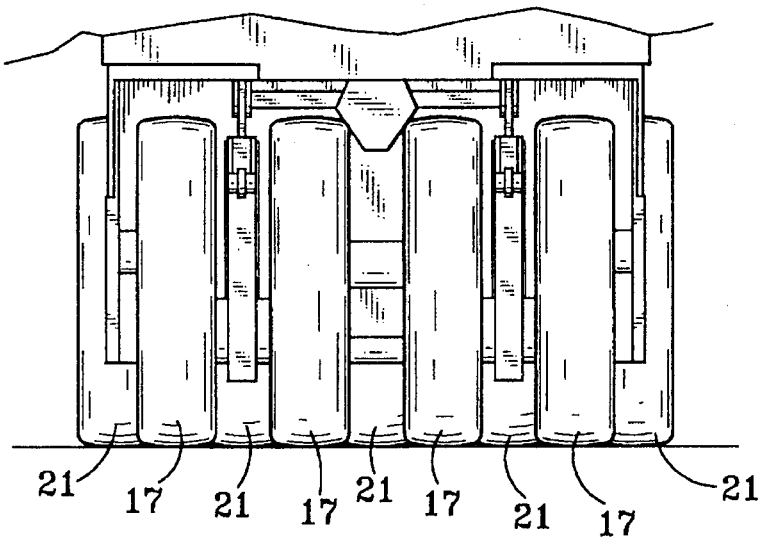
FIG. 2 is a front view of FIG. 1, with parts removed, showing the overlapping of front and rear rows of ground engaging surfaces of the tires.
Figure 3:
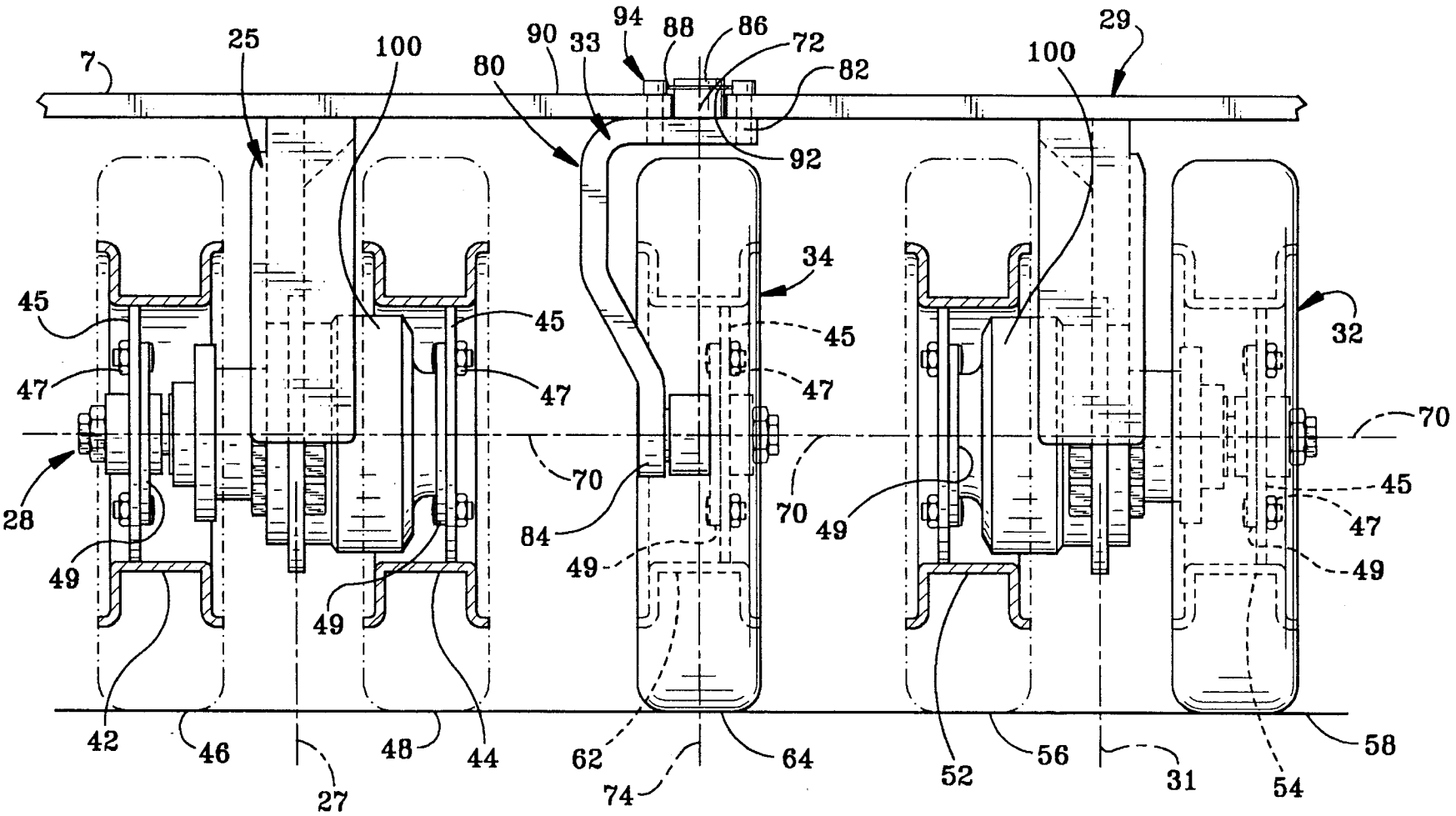
FIG. 3 is a schematic elevational view, partly in cross section, with parts removed, of the rear row of tires of the vehicle of this invention.

Now referring to FIGS. 1–3, a mobile, steerable ground compacting vehicle is shown generally as 1. As is well known, the compactor 1 includes an body 3, having a front frame portion 5 and a rear frame portion 7. An engine 9 powers the vehicle, which includes conventional steering mechanism (not shown) that is controlled by a steering wheel 11 positioned next to an operator's seat 13.

A first row 15 of laterally-spaced pneumatic tires 17 is connected to front frame portion 5, and a second row 19 of laterally-spaced pneumatic tires 21 is connected to rear frame portion 7. As shown in FIG. 2, the ground engaging portion of tires 17 on first row 15 are aligned with the spaces between tires 21 on second row 19 so as to cover, in a single pass, the entire area between outermost tires 21 on second row 19.

As seen in FIG. 3 first support means 25 is fixed to rear frame portion 7, extending downwardly therefrom along a first vertical plane 27. First support means 25 can be a plate, or other conventional support member, welded to frame portion 7. First support means 25 supports a first wheel means 28, as described hereinafter.

Second support means 29 is likewise fixed to rear frame portion 7, extending downwardly therefrom along a second vertical plane 31, parallel to first vertical plane 27, and spaced laterally from first support means 25. Second support means 29 can be a plate, or other conventional support member, welded to frame portion 7. Second support means 29 supports a second wheel means 32, as described hereinafter.

Third support means 33 is pivotally connected to rear frame portion 7, as described hereinafter, and spaced intermediate first support means 25 and second support means 29. Third support means 33 supports a third wheel means 34, as described hereinafter.

First support means 25 connects to a first wheel assembly that is a pair of spaced-apart, parallel, annular rims 42, 44 upon which is mounted a pneumatic tire 46, 48. First vertical plane 27 extends between rims 42, 44. Second support means 29 connects to a second wheel assembly that is a pair of spaced-apart, parallel, annular rims 52, 54 upon which is mounted a pneumatic tire 56, 58. Second vertical plane extends between rims 52, 54. Third support means 33 connects to a third wheel assembly that is a single, annular tire rim 62 upon which is mounted a single pneumatic tire 64.

Each tire rim 42, 44, 52, 54 and 62 is mounted at its center plate 45 by lug nuts 46 to a face plate 48 on a hub of its adjacent support means 25, 29 and 33, respectively. Wheel means 28, 32 and 34 are journalled for rotation about a horizontal axis 70, axis 70 being the same for first, second and third wheel means 28, 32 and 34. Axis 70 is perpendicular to vertical planes 27 and 31.

Third support means 33 is pivotable through 360 degrees about a pivot axis 72 in a third vertical plane 74, as described hereinafter. Third support means comprises a support arm 80 having a first end 82 and a second end 84. First end 82 is pivotally connected to rear frame portion 7 at axis 72 via a pivot shaft 86 that extends through aperture 88 in frame member 90. Second end 84 is rotatably connected to center plate 45 of rim 64. Thus, it is understood that third support means 33, rim 62 and tire 64 extend vertically along third vertical plane 74, with tire 64 symmetrically positioned on axis 72. To permit this arrangement, first end 82 of arm 80 is cantilevered away from axis 72 and thereafter extends downwardly to form a generally "C" shaped member that terminates at second end 84. The cantilevered "C" shape thereby spans an upper half of tire 64 on rim 62, extending on one side thereof. The arm 80 can be formed in a different shape from the "C" shape, so long as the tire and rim are spanned by the arm 80, as described herein.

Shaft 86 is retained in position by a removable snap ring 92 positioned in a groove in shaft 86. Removable bolts 94 inserted through frame member 90 and into first end 82 keep arm 80 from pivoting when the vehicle is in motion.

First and second wheel assemblies 28 and 32 are driven wheel assemblies, each having a conventional hydrostatic motor 100 mounted thereon, as is well known.

In operation, the removal of inner rim 44 can proceed as follows: Third rim 62 and tire 64 are first removed. Thereafter, nuts 94 are removed to permit the pivoting of arm 80, to provide access to the lug nuts 46 on either first rim 44 or second rim 52. Rims 44, 52 are replaced and the third rim 62 replaced and locked into position.

Having described the invention, what is claimed is:

1. In a mobile, steerable ground compacting vehicle having a body with a front frame portion and a rear frame portion, said body supported by a first row of laterally spaced wheels connected to said front frame portion, and a second row of laterally spaced wheels connected to said rear frame portion, the wheels of each row being aligned with the spaces of the other row, so that a ground engaging portion of said first and second rows overlap to cover an area between outermost wheels, said second row of wheels comprising:

(a) first support means fixed to said rear frame portion, extending downwardly from said rear frame portion along a first vertical plane, and a first wheel assembly removably fastened to said first support means;

(b) second support means fixed to said rear frame portion, extending downwardly from said rear frame portion along a second vertical plane parallel to said first vertical plane, said second support means spaced laterally from said first support means, and a second wheel assembly removably fastened to said second support means;

(c) third support means extending downwardly from said rear frame portion, said third support means spaced intermediate said first and second support means, and a third wheel assembly removably fastened to said third support means (d) means for pivoting said third support means about an axis in a third vertical plane parallel to said first and second vertical planes, whereby spacing between said third support means and said first and second support means can be varied, to provide access to said first and second wheel assemblies for replacement thereof; and (e) said third support means being separate from, and unconnected to, said first row of wheels.

2. The vehicle of claim 1 further including means for locking said third support means from pivoting during movement of said vehicle.

3. The vehicle of claim 2 wherein said first wheel assembly is removably mounted on said first support means for rotation about a first horizontal axis perpendicular to said first vertical plane.

4. The vehicle of claim 3 wherein said second wheel assembly is removably mounted on said second support means for rotation about a second horizontal axis perpendicular to said second vertical plane.

5. The vehicle of claim 4 wherein said third wheel assembly is removably mounted on said third support means for rotation about a third horizontal axis perpendicular to said third vertical plane.

6. The vehicle of claim 5 wherein said first wheel assembly comprises a first pair of parallel, spaced-apart wheels, said first vertical plane extending between said first pair of wheels.

7. The vehicle of claim 6 wherein said second wheel assembly comprises a second pair of parallel, spaced apart-wheels, said second vertical plane extending between said second pair of wheels.

8. The vehicle of claim 7 wherein said third wheel assembly comprises a single wheel, said single wheel extending along said third vertical plane.

9. The vehicle of claim 8 further including means mounted on said first support means for driving said first wheel assembly.

10. The vehicle of claim 9 further including means mounted on said second support means for driving said second wheel assembly.

11. The vehicle of claim 10 wherein said means for driving said first wheel assembly includes a first hydrostatic motor.

12. The vehicle of claim 11 wherein said means for driving said second wheel assembly includes a second hydrostatic motor.

13. In a mobile, steerable ground compacting vehicle having a body with a front frame portion and a rear frame portion, said body supported by a first row of laterally spaced wheels connected to said front frame portion, and a second row of laterally spaced wheels connected to said rear frame portion, the wheels of each row being aligned with the spaces of the other row, so that a ground engaging portion of said first and second rows overlap to cover an area between outermost wheels, said second row of wheels comprising:

(a) a first wheel support member fixed to said frame portion, extending downwardly from said frame portion along a first vertical plane, for supporting a first pair of wheels for rotation about a first horizontal axis perpendicular to said first vertical plane;

(b) a second wheel support member fixed to said frame portion, extending downwardly from said frame portion along a second vertical plane, for supporting a second pair of wheels for rotation about a second horizontal axis perpendicular to said second vertical plane;

(c) a third wheel support member extending downwardly from said frame portion, said third wheel support member spaced intermediate said first and second wheel support members, said third wheel support member for supporting a third wheel for rotation about a third horizontal axis perpendicular to said third vertical plane, said third wheel support member pivotable with respect to said frame portion about an axis in a third vertical plane, whereby spacing between said third wheel support member and said first and second wheel support members can be varied; and (d) said third wheel support member means being separate from, and unconnected, to said first row of wheels.

14. The vehicle of claim 8 wherein said third support means comprises a support arm having a first and second end, said first end being pivotally connected to said rear frame portion at said axis, said second end being rotatably connected to a center plate on said single wheel at said axis, said support arm forming a "C" shaped portion between said first and second ends to span an upper half of said wheel.

* * * * *